US011963626B1

(12) United States Patent
Dickson, II

(10) Patent No.: US 11,963,626 B1
(45) Date of Patent: Apr. 23, 2024

(54) RELEASABLE LOCKING HOLE-ENGAGING MOUNT

(71) Applicant: Wilburne A. Dickson, II, Justin, TX (US)

(72) Inventor: Wilburne A. Dickson, II, Justin, TX (US)

( * ) Notice: Subject to any disclaimer, the term of this patent is extended or adjusted under 35 U.S.C. 154(b) by 0 days.

(21) Appl. No.: 17/966,699

(22) Filed: Oct. 14, 2022

(51) Int. Cl.
*A47F 5/08* (2006.01)

(52) U.S. Cl.
CPC ..... *A47F 5/0823* (2013.01)

(58) Field of Classification Search
CPC ..... A47F 5/0823
See application file for complete search history.

(56) References Cited

U.S. PATENT DOCUMENTS 3,484,069 A * 12/1969 Larson ..... A47F 5/0823 211/100
4,113,109 A * 9/1978 Donnelli ..... B65D 77/22 211/49.1
4,258,892 A 3/1981 Craine
4,452,360 A * 6/1984 Barnes ..... A47F 5/0823 248/222.51
4,506,856 A 3/1985 Rich et al.
4,516,681 A * 5/1985 Jahel ..... A47F 5/0823 211/104
5,165,640 A 11/1992 Williams, 3rd
5,209,451 A 5/1993 Vierling
5,222,608 A * 6/1993 Eklof ..... A47F 1/128 211/54.1
6,003,685 A 12/1999 Malin
6,601,808 B1 * 8/2003 Nagel ..... A47F 5/0823 248/220.31
8,302,923 B2 11/2012 Johnston et al.
8,684,196 B2 4/2014 Kozak et al.
10,072,788 B2 9/2018 Chinn et al.
10,226,138 B2 3/2019 Tear
D848,243 S * 5/2019 Gupta ..... D8/354
(Continued)

OTHER PUBLICATIONS

Store Fixture Direct pegboard utility notch hook for picture hanger sold on amazon, dated Jan. 24, 2018, https://www.amazon.com/Pegboard-Utility-Notch-Hook-Slatwall/dp/B07993QHWB (Year: 2018).*

*Primary Examiner* — Terrell L McKinnon
*Assistant Examiner* — Ding Y Tan
(74) *Attorney, Agent, or Firm* — D. Tiller Law PLLC; Don Tiller

(57) ABSTRACT

A mount for engaging a perforated surface includes a locking member and a tine member connected to each other such that they can rotate relative to each other. The locking member includes a surface designed to face the perforated surface when mounted to the perforated surface. The tine member includes a mounting plate and a tine. The tine is bent such that it extends substantially perpendicular to the mounting plate at the point it is connected to the mounting plate (the proximal end) and substantially parallel to the mounting plate at the point furthest from the mounting plate (the distal end). In use, the distal end of the tine is inserted into a hole of the perforated surface, the locking member is pivoted toward the perforated surface, and the locking member is then rotated relative to the tine member so as to prevent extraction of the tine from the hole.

10 Claims, 16 Drawing Sheets

(56) References Cited

U.S. PATENT DOCUMENTS

| | | | | |
|---|---|---|---|---|
| 10,827,853 | B2 | 11/2020 | Ma et al. | |
| 2007/0012832 | A1 | 1/2007 | Ottens et al. | |
| 2009/0173853 | A1 | 7/2009 | Fawcett et al. | |
| 2009/0266953 | A1* | 10/2009 | Goldstein | A47F 5/0869 248/214 |
| 2017/0140632 | A1* | 5/2017 | Klein | G08B 21/18 |
| 2018/0116427 | A1* | 5/2018 | Gupta | A47F 5/0823 |
| 2018/0231176 | A1* | 8/2018 | Sabounjian | F16M 13/02 |
| 2020/0329889 | A1* | 10/2020 | Wen | F16B 45/00 |

* cited by examiner

B-B

B-B

RELEASABLE LOCKING HOLE-ENGAGING MOUNT

BACKGROUND AND SUMMARY

This invention pertains generally to mounts that releasably secure to a surface having holes, such as item-holding mounts attachable to a pegboard through engagement with holes in the pegboard. More specifically, the invention is directed to technology that enables attachment of a mount to holes in a surface in a lockable yet releasable fashion. This technology includes a tine member with one or more tines to engage one or more holes in a surface and a locking member pivotably joined with the tine member and selectively rotatable to a first position that allows the tine(s) to engage the hole(s) and to a second position that prevents the tine(s) from disengaging the hole(s) thereby securing the mount to the surface.

It is often desirable to mount items to surface using holes in the surface. There are many approaches to doing so, from anchors that permanently screw into the holes to hooks that are temporarily placed into the holes. One problem with permanent mounts is that they are permanently attached to the surface and are therefore not readily configurable for changing uses. One problem with temporary mounts is that they can inadvertently release from the surface. There is a need for a mount that removably—yet securely—attaches to a surface through holes in the surface (such a surface is referred to herein through exemplary embodiments such as a "perforated board" or a "pegboard").

In one aspect of the invention, a mount for selectively and securely engaging holes in a mounting surface such as a perforated board includes a locking member and a tine member. The locking member includes a surface (the front surface) configured to face the mounting surface in use. The tine member includes a mounting plate and a bent tine extending from the mounting plate substantially perpendicular to the mounting plate at the point it connects to the mounting plate (the proximal end of the tine) and substantially parallel to the mounting plate at the point of the tine away from the mounting plate (the distal end of the tine). The tine is configured to engage a hole in the mounting surface by fitting within the hole and, when oriented such that the distal end of the tine is substantially parallel to the mounting surface, contact the hole edges at a point on the tine that is substantially perpendicular to the mounting plate. The tine member is pivotably mounted to the front surface of the locking member such that the tine member and locking member may rotate relative to each other while distal portion of the tine remains substantially parallel to the front surface of the locking member. The tine member and locking member are dimensioned and relatively positioned such that in a first (unlocked) rotational configuration of the tine member relative to the locking member, the distal end of the tine protrudes past an edge of the locking member such that it can be inserted into a hole and in a second (locked) rotational configuration of the tine member relative to the locking member, the tine does not protrude past an edge of the locking member and the mount is thereby secured in place if mounted to a mounting surface. The tine member may include additional tines similar to the first. The tine member may include a pin projecting substantially perpendicular from the mounting plate, the pin configured to engage a hole of the mounting surface. The locking member may include a detent with a spring-biased pin configured to engage a hole of the mounting surface and thereby prevent rotation of the locking member relative to the mounting surface or tine member when the mount is installed on the mounting surface.

In another aspect of the invention, an extended mount includes two locking members as described above, each connected to a spanning member. Each locking member may be connected to the spanning member with a hinge: one leaf of the hinge pivotably connected to the spanning member such that leaf and spanning member may rotate relative to each other; the other leaf of the hinge connected to the locking member. This configuration enables three rotational degrees of freedom for each locking member relative to the spanning member.

BRIEF DESCRIPTION OF THE DRAWINGS

These and other features, aspects, and advantages of the present invention may be better understood with reference to the following description, appended claims, and accompanying drawings where:

DETAILED DESCRIPTION

Figure 1A:
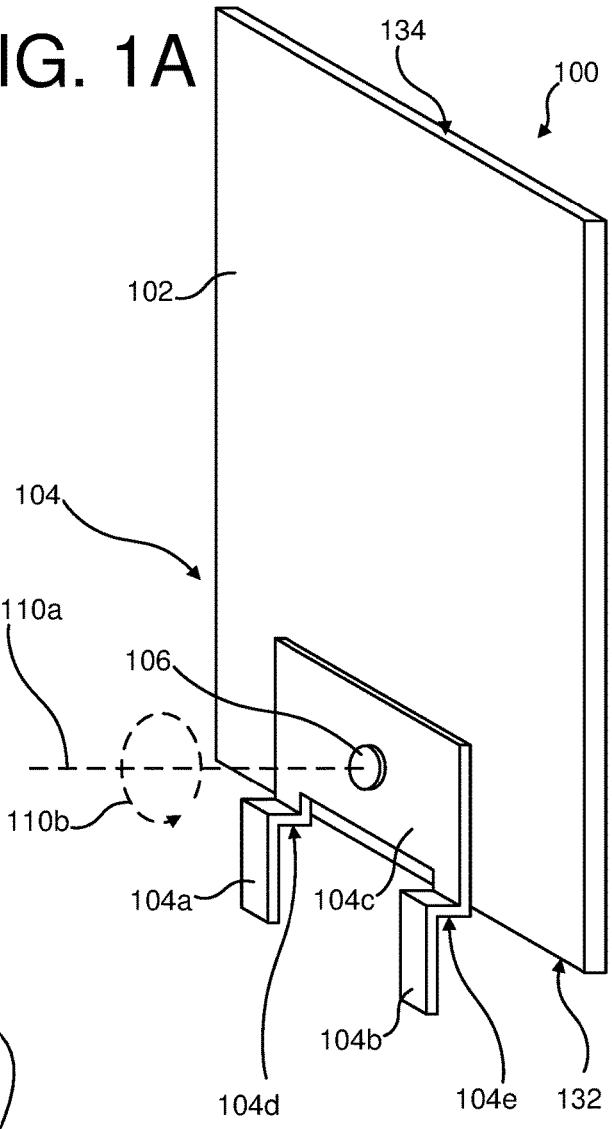
FIGS. 1A and 1B are perspective views illustrating an exemplary two-tine locking pegboard mount according to an aspect of the invention.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

Figure 1B:
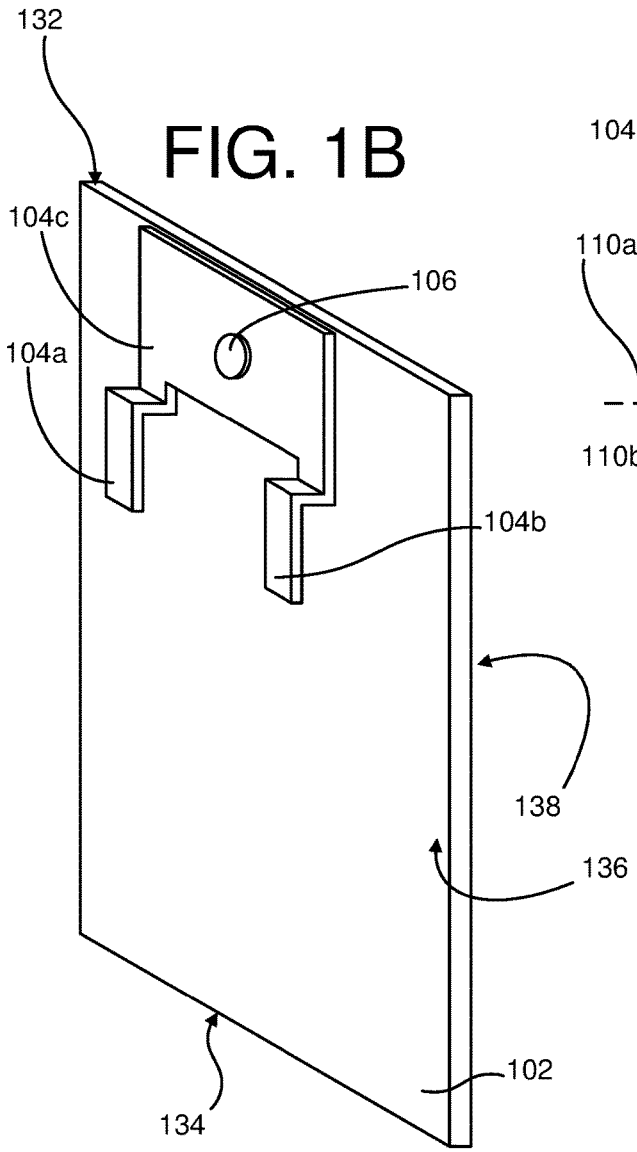

FIGS. 1A and 1B are perspective views illustrating an exemplary locking pegboard mount 100 in the unlocked (FIG. 1A) and locked (FIG. 1B) configurations. The locking mount 100 includes a locking plate 102 and a pegboard engagement module 104 (also referred to as a tine plate or tine member herein). The engagement module 104 includes one or more bent tines 104*a*, 104*b* extending out and from a mounting plate 104*c*. The tines 104*a*, 104*b* are configured to engage a mounting hole of a pegboard: they are bent such that the proximal portion of the tine 104*a*, 104*b* extends out from the front face 136 of the locking plate 102 providing a surface 104*d*, 104*e* to engage the inside surface of a hole. The distal portion of the tine 104*a*, 104*b* extends substantially parallel to the front face of the locking plate 102. The engagement module 104 is pivotably attached to the front face 136 of the locking plate 102 near the first end 132 of the locking plate 102 through, e.g., a pivot pin 106 that secures the mounting plate 104*c* to the locking plate 102. (Here, the "front face" 136 refers to the surface of the locking plate 102 to which the mounting plate 104*c* is attached, and the "back" to the opposite surface 138. In use, the front 136 will face the pegboard. The "proximal" and "distal" portions of the tines refer to, respectively, the portion of the tine at which the tine 104*a*, 104*b* is attached to the mounting plate 104*c* and the portion of the tine situated away from the proximal portion.)

In one example of a pivotal connection between the engagement module 104 and the locking plate 102, the mounting plate 104*c* and locking plate 102 may each include a hole through which the pivot pin 106 may be placed, the mounting plate 104*c* and locking plate 102 are stacked such that the holes align, and the pivot pin 106 is placed through the aligned holes such one end of the pin 106 protrudes from the front surface of the mounting plate 104*c* and the other end of the pin 106 protrudes from the back surface of the locking plate 102. Then, the two protruding ends of the pin 106 may be flared to secure the mounting 104*c* and locking plates 102 between the flares.

Another potential configuration includes a pin with a head on one end that is too large to fit through either of the holes and that is configured on the other end to secure into one of the holes (e.g., through thread engagement or friction fit).

Another potential configuration includes a pin that is integral to one of the plates 102, 104*c*, is configured to extend through a hole in the other plate 102, 104*c*, and is then secured in place using, e.g., a nut or snap ring on the pin end that extends through the hole. The key is that that locking plate 102 and engagement module 104 are secured together so that they are relatively pivotable about the pin. This enables rotation 110*b* of the module 104 relative to the locking plate 102 about an axis 110*a* extending from the front face of the locking plate 102. (The rotation 110*b* and axis 110*a* are shown in dashed lines in FIG. 1A. The import of this rotation is described below.)

In the unlocked configuration shown in FIG. 1A, the tine plate 104 is oriented to the locking plate 102 such that the tines 104*a*, 104*b* protrude past the first end 132 of the locking plate 102. (As is described below, this protrusion enables the bent tines 104*a*, 104*b* to engage holes of a pegboard.)

In the locked configuration shown in FIG. 1B, the engagement module 104 is oriented (rotated) with respect to the locking plate 102 roughly 180 degrees off the unlocked position shown in FIG. 1A. In the locked configuration, the tines 104*a*, 104*b* do not protrude past either end 132, 134 of the locking plate 102. (As described below, the lack of protrusion secures tines 104*a*, 104*b* in the holes of a pegboard when engaged with the pegboard in the locked configuration.)

Figure 2A:
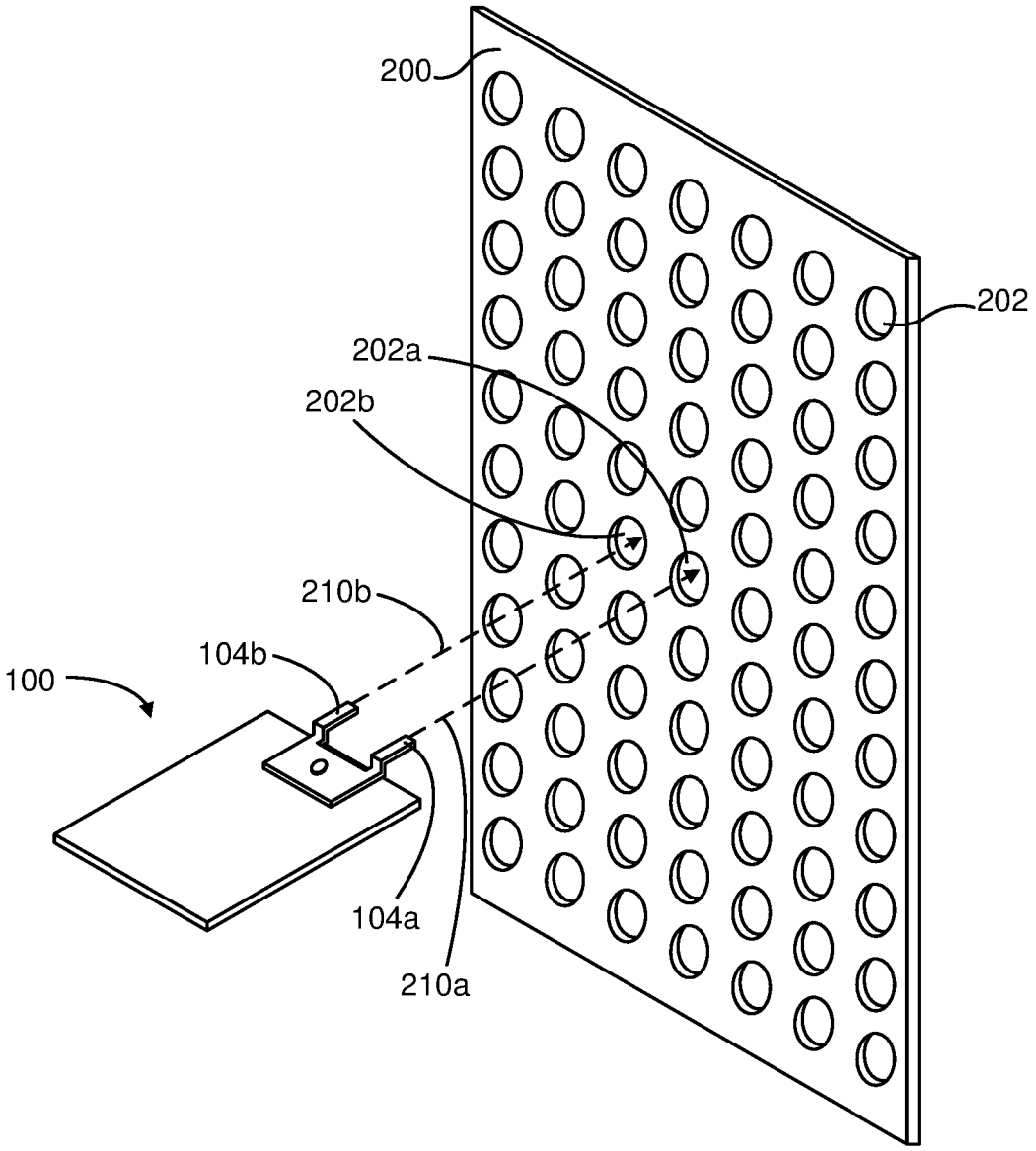
FIGS. 2A-2G are various views illustrating the engagement of an exemplary two-tine locking pegboard mount with a pegboard.
Figure 2B:
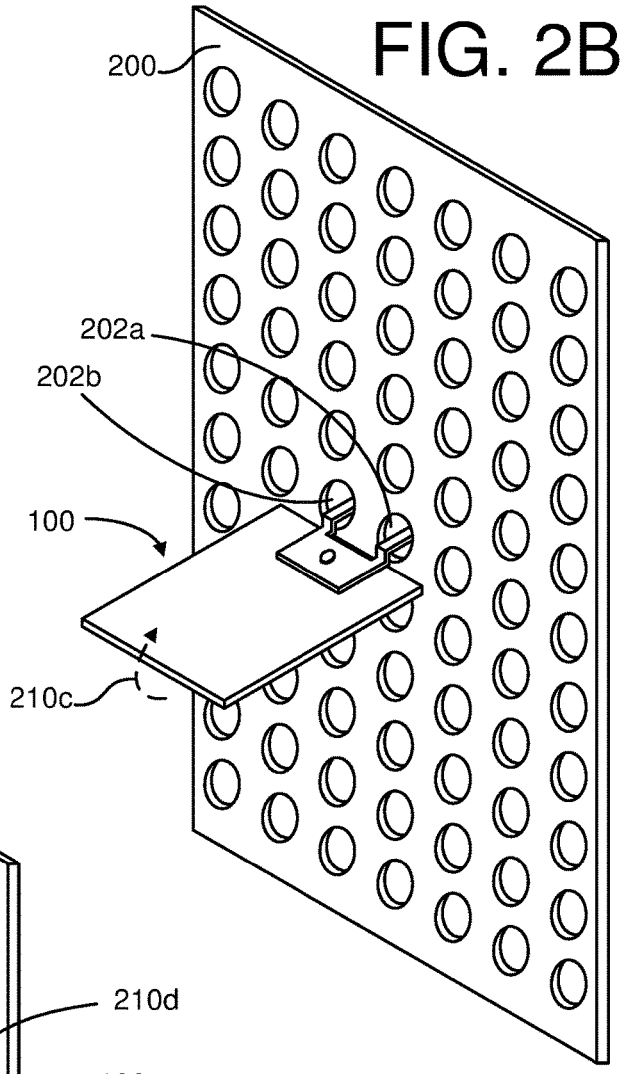
Figure 2C:
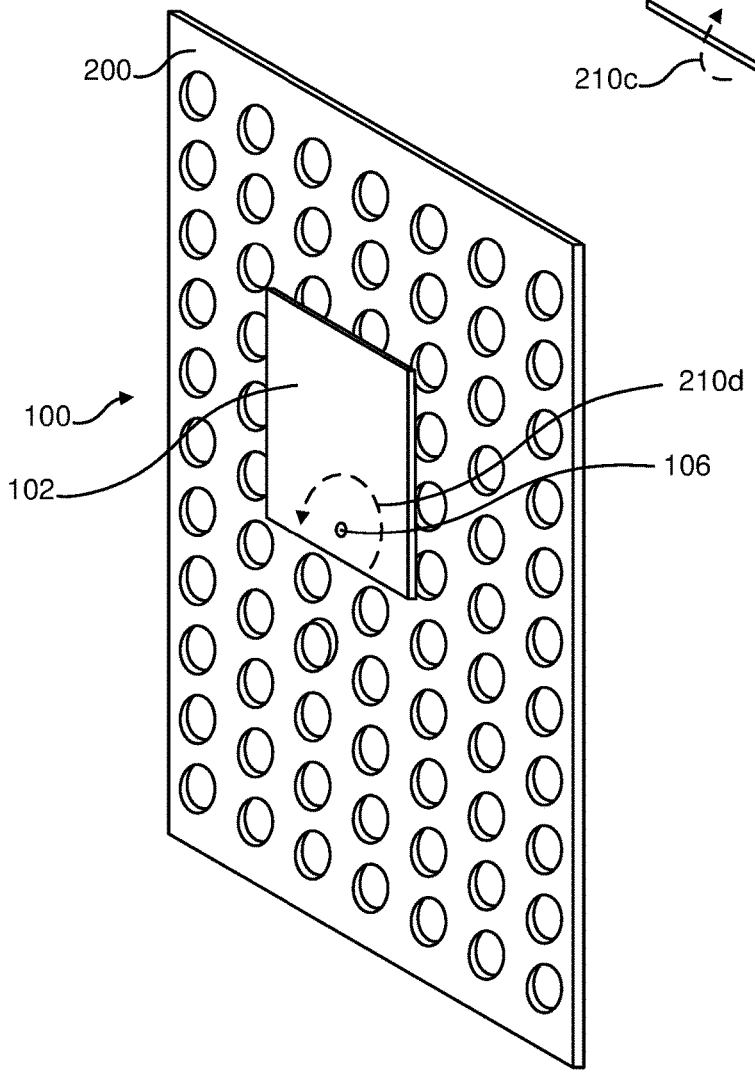
Figure 2D:
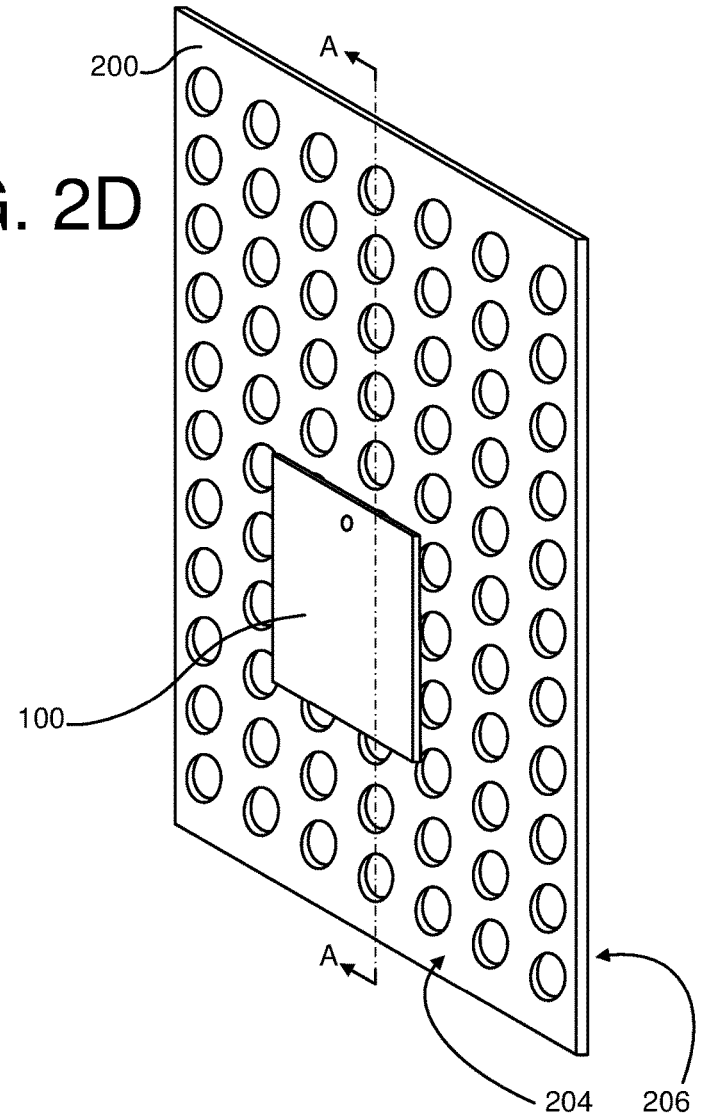
Figure 2E:
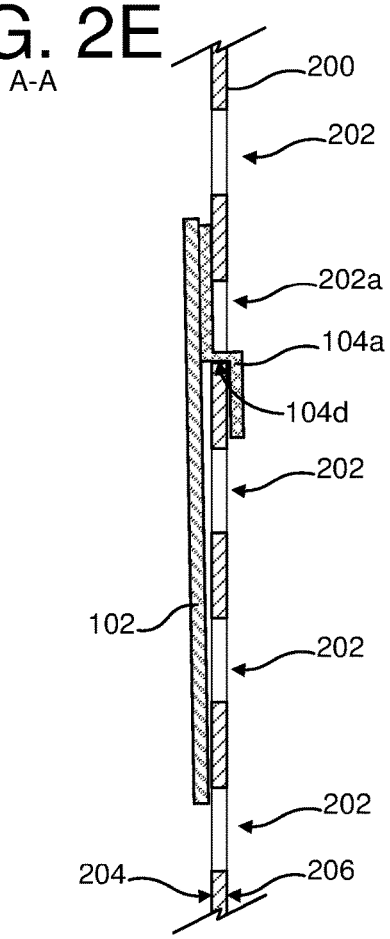

FIGS. 2A through 2G are various views of the exemplary locking pegboard mount 100 engaging with a pegboard 200. The pegboard 200 includes a pattern of holes 202. The two tines 104*a*, 104*b* of the tine plate 104 are configured to fit within two of the holes 202*a*, 202*b*. To install the locking pegboard mount 100 on the pegboard 200, the mount 100 is placed into an unlocked configuration (as shown in FIG. 1A) and the tines 104*a*, 104*b* are inserted into holes 202*a*, 202*b* in the pegboard 200, as depicted in FIG. 2B. (This insertion is represented in FIG. 2A with the dashed lines 210*a*, 210*b*.) The mount 100 is then rotated 210*c* relative to the pegboard 200 such that the front face 136 of the locking plate 102 is facing the pegboard 200, as depicted in FIG. 2C. (This rotation 210*c* is represented in FIG. 2B with an arced dashed line 210*c*.) The locking plate 102 is then rotated 210*d* about the pivot pin 106 such as to invert the positions of the first 132 and second 134 ends of the locking plate 102, as depicted in FIG. 2D. (This rotation 210*d* is represented in FIG. 2C with the broken-circle dashed line 210*d*. In this example, the rotation is roughly 180 degrees. But the invention is not limited to such a rotation. A lesser rotation may be sufficient for the locking plate 102 to lock the engaged tines in place.) FIG. 2E is a view of portion of section A-A from FIG. 2D. In FIGS. 2D and 2E, the mount 100 is in its locked configuration shown in FIG. 1B, but as engaged with the pegboard 200: the tines 104*a*, 104*b* placed through two holes 202*a*, 202*b* engage the back side 206 of the pegboard 200 while the locking plate 102 engages the front side 204 of the pegboard 200 to prevent disengagement of the tines 104*a*, 104*b* from the pegboard. (The "front" side of the pegboard is the surface of the pegboard that faces the mount 100. The "back" side of the pegboard faces away from the mount 100.)

Figure 2F:
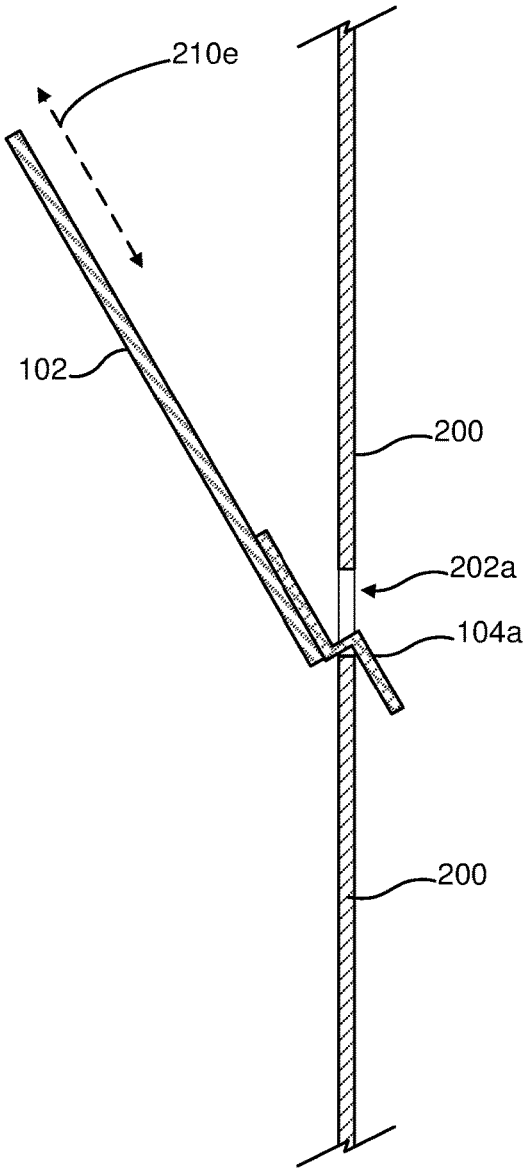
Figure 2G:
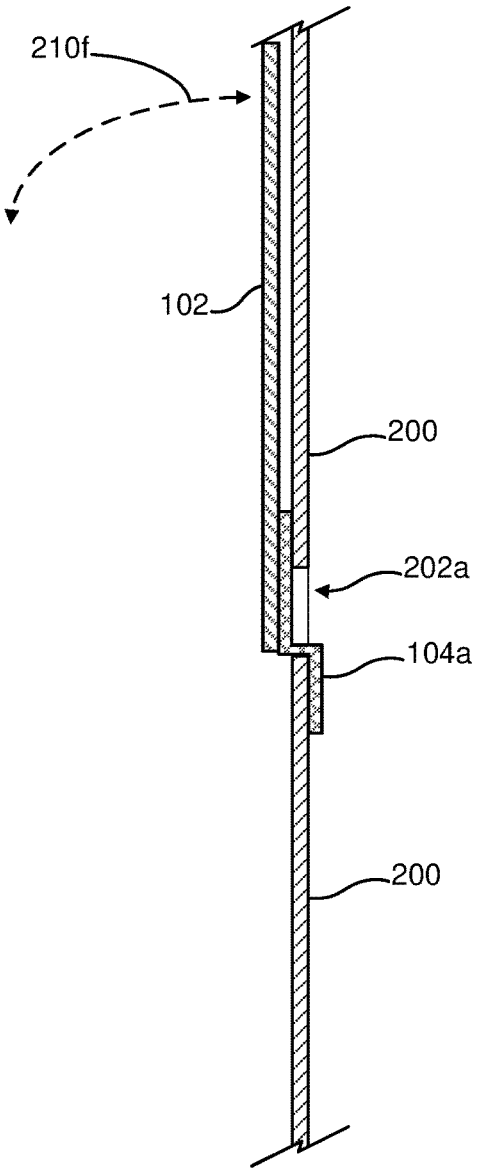

FIGS. 2F and 2G are side sectional views analogous to the view of FIG. 2E. (For sake of simplicity, the holes 202 other than the hole 202*a* engaged by a tine 104*a* have been omitted from the figures.) In the configuration depicted in FIG. 2F, the mount 100 is in its unlocked configuration (shown in FIG. 1A) and may be moved 210*e* to insert or extract the tines 104*a*, 104*b* into or from the holes 202*a*, 202*b*.

In the configuration depicted in FIG. 2G, the mount 100 is still in its unlocked configuration and may be pivoted 210*f* about the engagement point between the tines 104*a*, 104*b* and the engaged holes 202*a*, 202*b*. When installing the mount 100 to the pegboard 200, the locking plate 102 would then be rotated about the pivot pin 106 to place the engaged mount 100 into its locked configuration (as illustrated in FIG. 2E). When uninstalling the mount 100, the locking plate 102 may be pivoted 210*f* away from the pegboard 200 (as illustrated in FIG. 2F) after the locking plate 102 is moved from its locked position to its unlocked position.

Figure 3A:
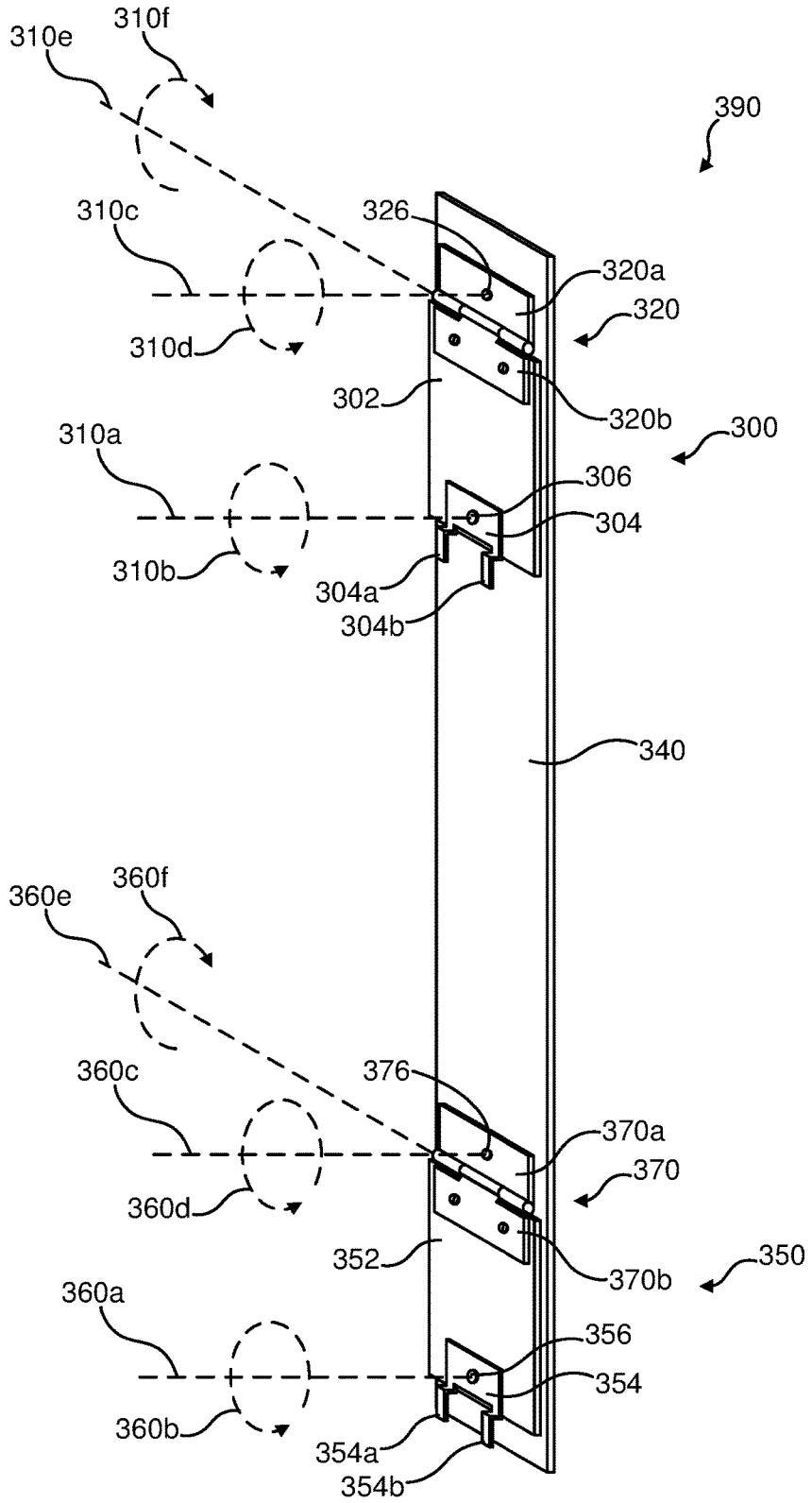
FIGS. 3A and 3B are perspective views illustrating an exemplary extended locking pegboard mount according to an aspect of the invention.
Figure 3B:
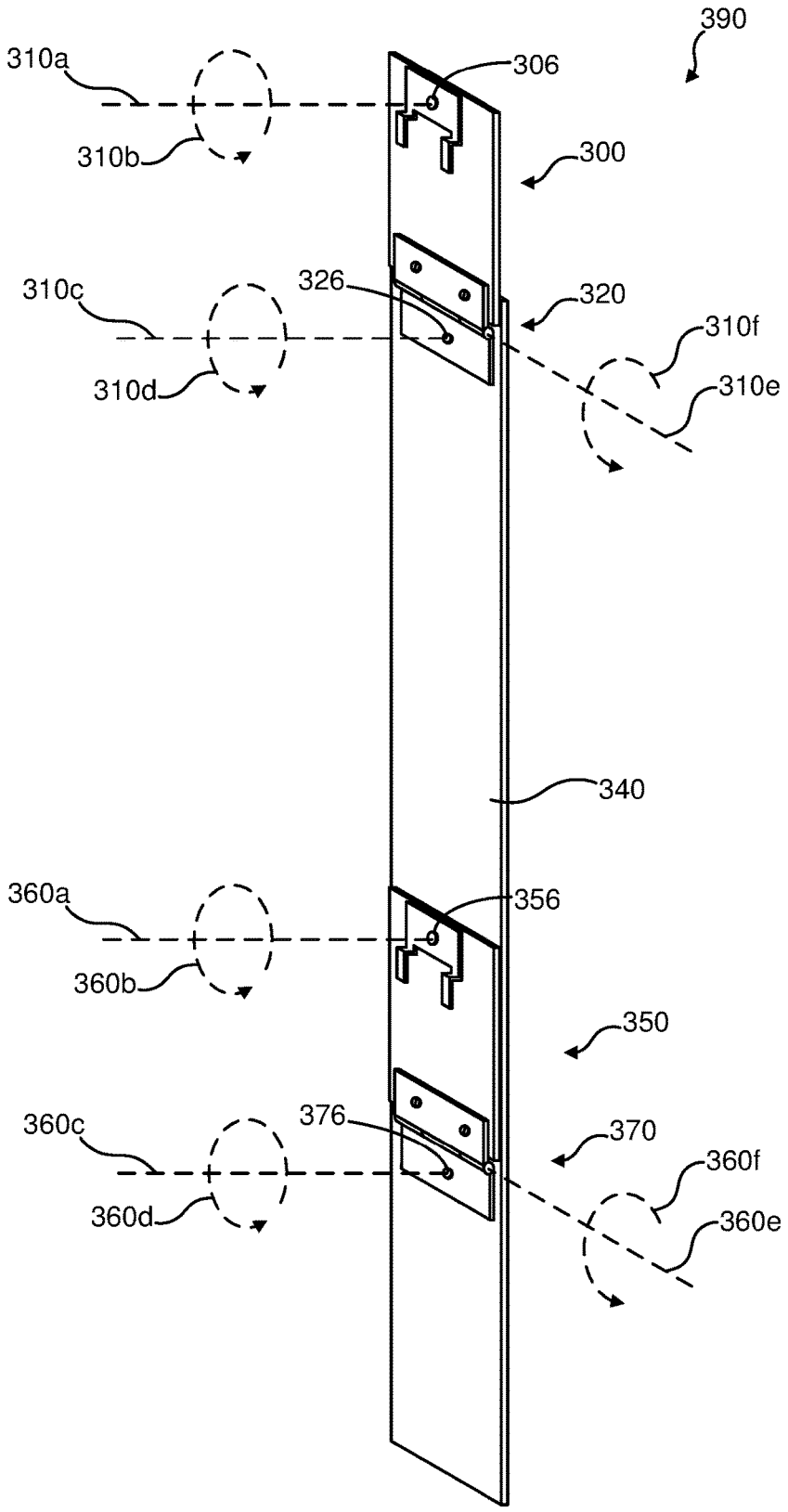

FIGS. 3A and 3B are perspective views illustrating an exemplary extended locking pegboard mount 390 in the unlocked (FIG. 3A) and locked (FIG. 3B) configurations. The extended mount 390 includes two locking mounts 300, 350 similar to that described with reference to FIGS. 1A and 1B. These mounts 300, 350 are connected to each other with a spanning plate 340 to create an "extended" pegboard mount. Each mount 300, 350 has a tine plate 304, 354 with tines 304*a*, 304*b*, 354*a*, 354*b* pivotably attached to a locking plate 302, 353 through a pivot pin 306, 356. Each mount 300, 350 is pivotably attached to the spanning plate 340 through a hinge 320, 370. One leaf 320*a*, 370*a* of each hinge 320, 370 is pivotably attached to the spanning plate 340 with a pivot pin 326, 376. A second leaf 320*b*, 370*b* of each hinge 320, 370 is attached to the locking plate 322, 352 of the mount 300, 350. Thus, each mount 300, 350 includes three rotational degrees of freedom: one rotation 310*f*, 360*f* of the mount 300, 350 relative to the spanning plate 340 about the hinge axis 310*e*, 360*e*; a second rotation 310*d*, 360*d* of the mount 300, 350 relative to the spanning plate 340 about the hinge-pivot-pin axis 310*c*, 360*c*; and a third rotation 310*b* of the tine plate 304, 354 relative to the locking plate 302, 352 about the pivot-pin axis 310*a*, 360*a*. These three rotational degrees of freedom of each mount 300, 350 work in concert to enable the extended mount 390 to engage and lock onto a pegboard.

Figure 4A:
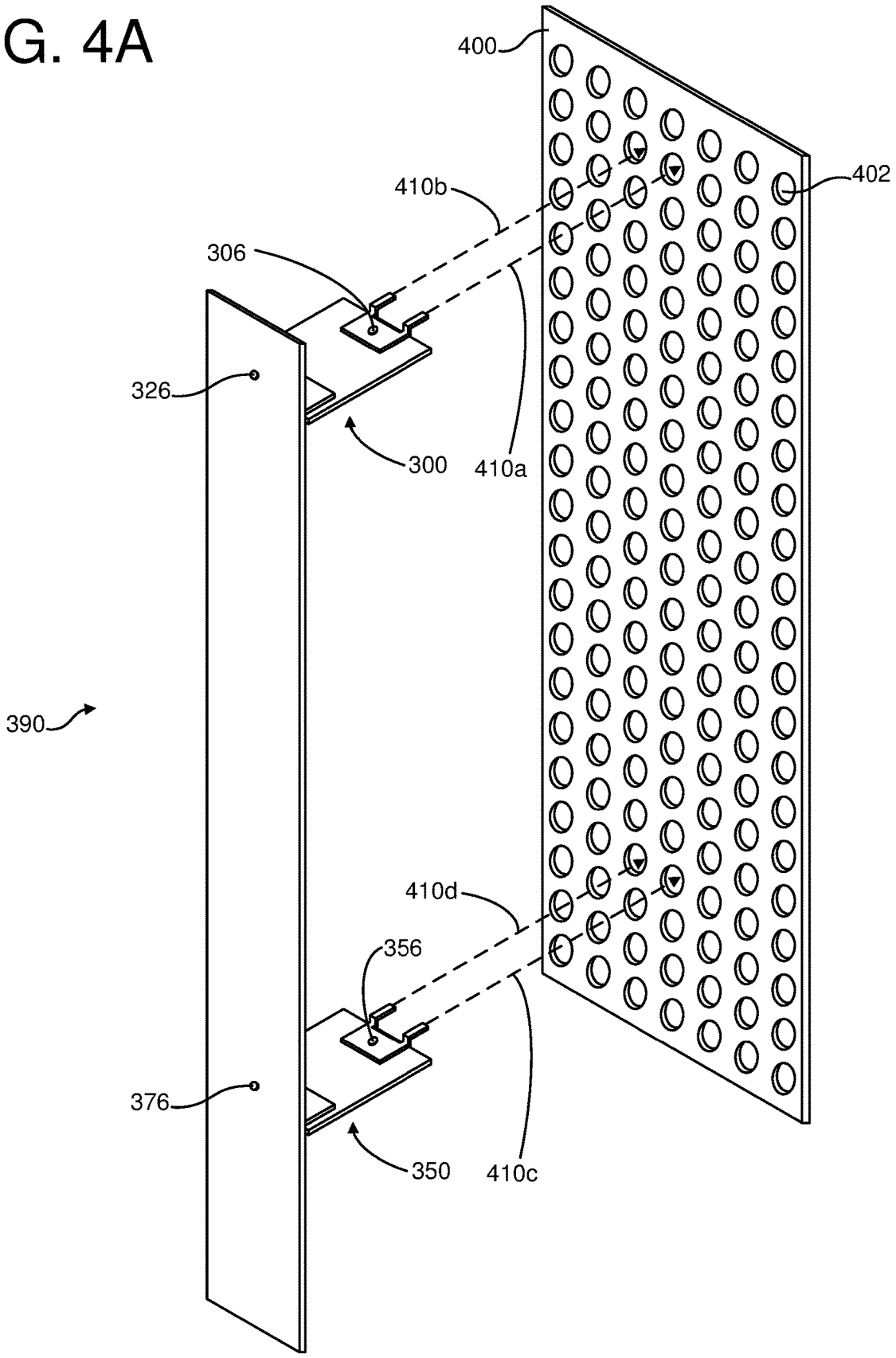
FIGS. 4A-4H are various views illustrating the engagement of an exemplary extended locking pegboard mount with a pegboard.
Figure 4B:
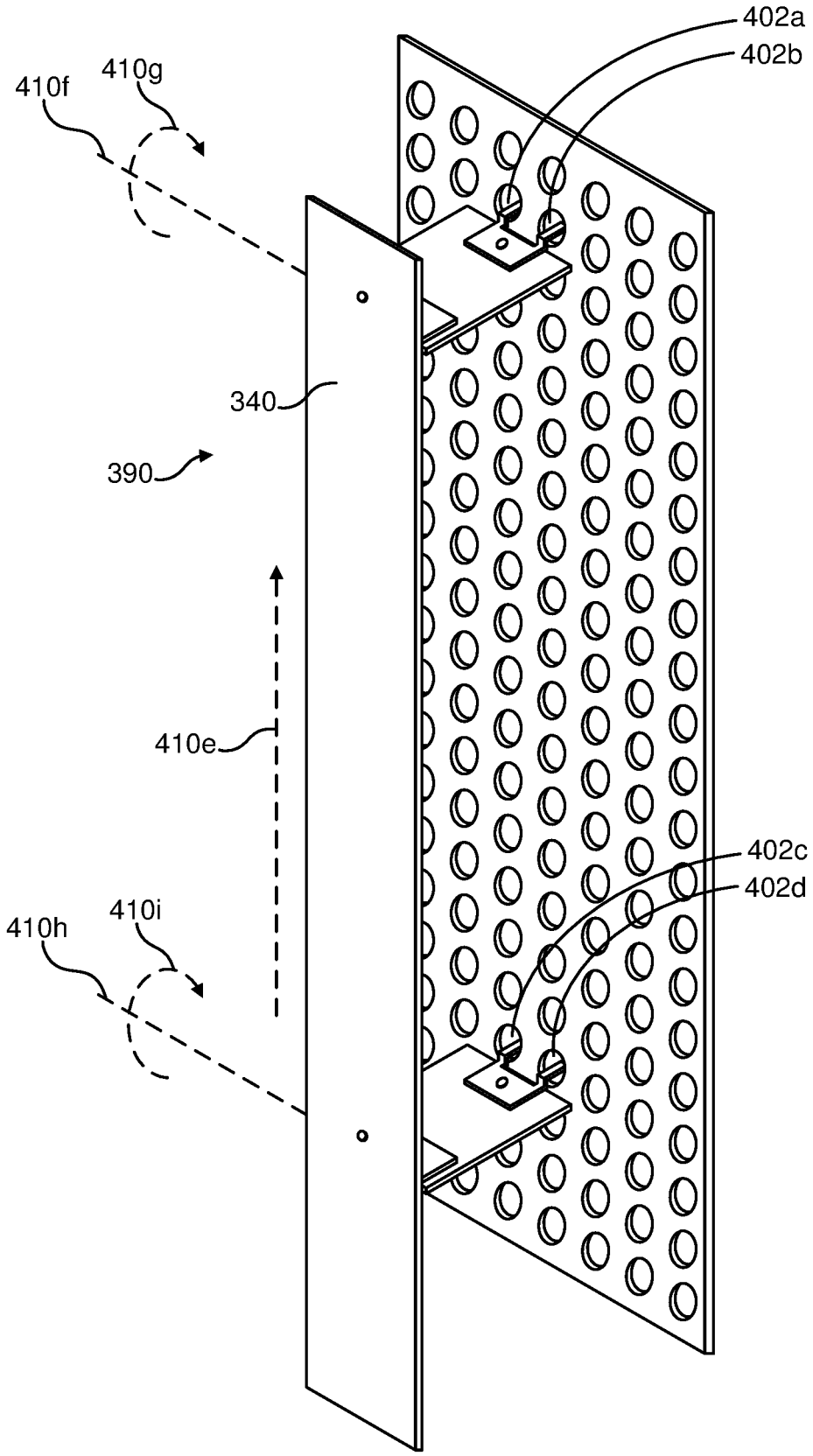
Figure 4C:
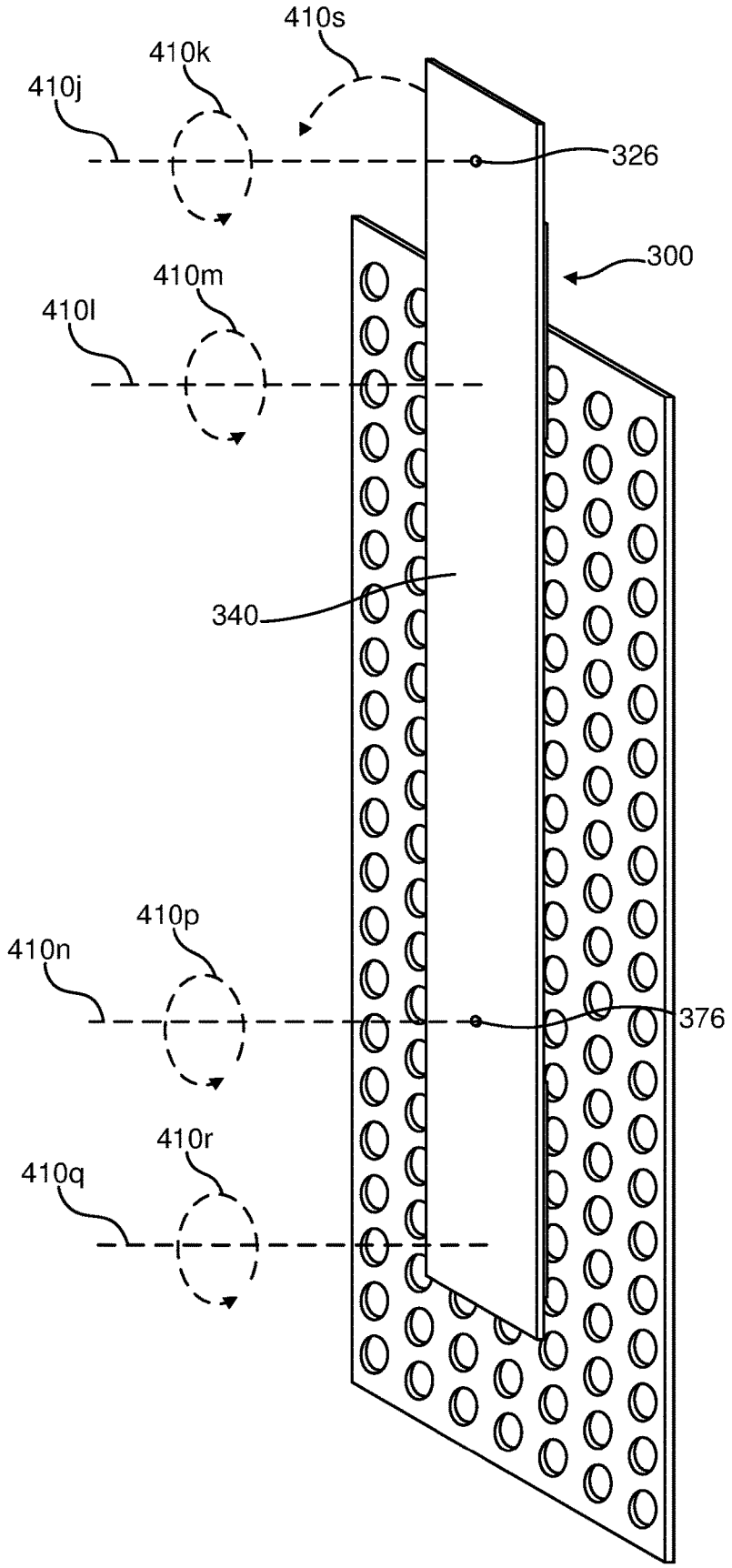
Figure 4D:
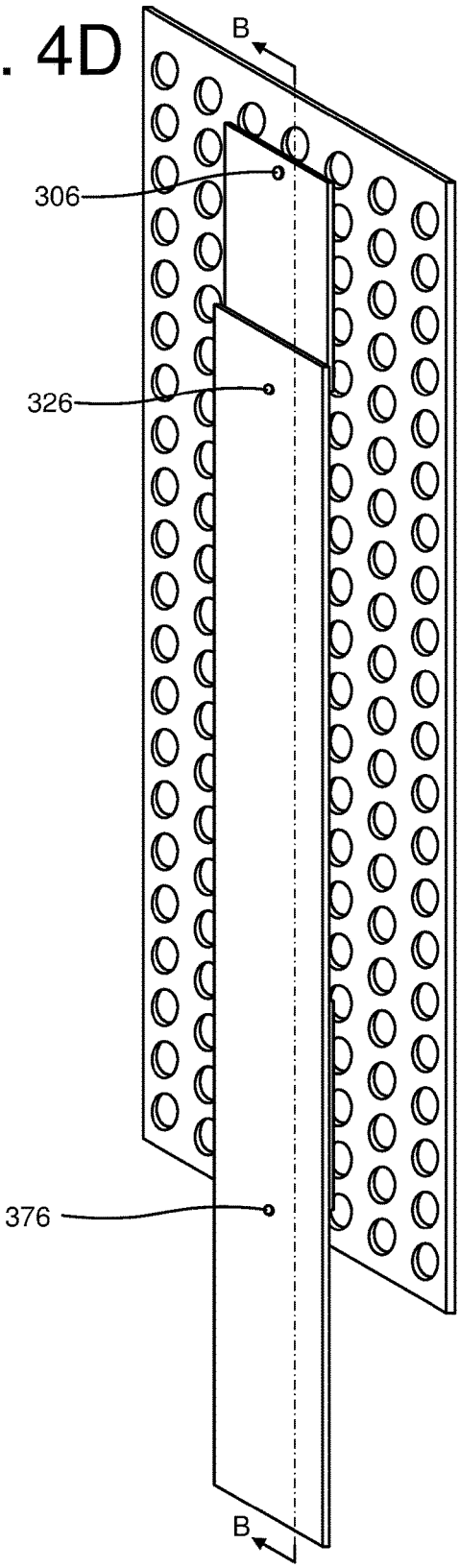

FIGS. 4A through 4H are various views of the exemplary extended locking pegboard mount 390 engaging with a pegboard 400. The pegboard 400 includes a pattern of holes 402. To install the extended mount 390 on the pegboard 400, the first mount 300 (topmost in the figure) and the second mount 350 (bottom in the figure) are each placed in its unlocked position and is pivoted out from the spanning plate 340 via the connecting hinges 320, 370. Then, the tines 304*a*, 304*b* of the first mount 300 are inserted into two holes 402*a*, 402*b* and the tines of 354*a*, 354*b* of the second mount 350 are inserted into two different holes 402*c*, 402*d*, as depicted in FIG. 4B. (This insertion is represented in FIG. 4A with the dashed lines 410*a*, 410*b*, 410*c*, 410*d*.) The spanning plate 340 is then translated 410*e* such that it pivots 410*g*, 410*i* with respect to each of the locking plates 302, 352 of the first and second mounts 300, 350 about their respective hinge axis 410*f*, 410*h* such that the front faces of the locking plates 302, 352 are facing the pegboard 400, as depicted in FIG. 4C. (This translation 410*e* is represented in FIG. 4B with a dashed line 410*e* and the hinge rotations 410*g*, 410*i* are represented in the figure arced dashed lines 410*g*, 410*i*.) The spanning plate 340 is then moved such that it rotates 410*k*, 410*p* about the hinge-pivot-pin axes 410*j*, 410*n* in turn causing the locking plates 302, 352 to rotate 410*m*, 410*r* with respect to their respective tine plates 304, 354 to place the extended mount 390 in its locked configuration, as depicted in FIG. 4D.

Figure 4E:
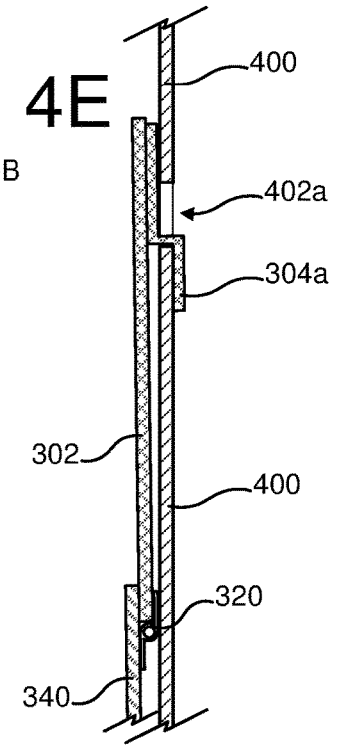
Figure 4F:
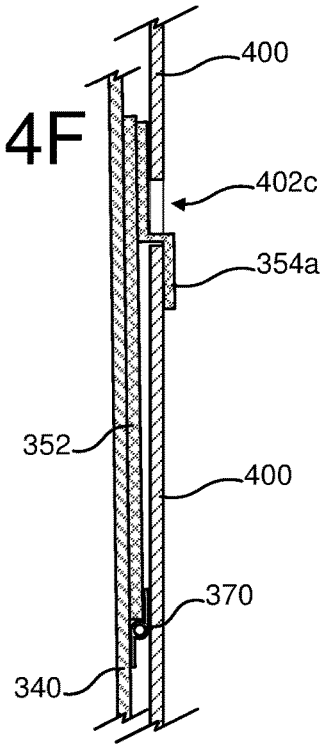

FIGS. 4E and 4F are views of portions of section B-B from FIG. 4D. In the locked configuration on the pegboard 400: the first mount 300 tines 304*a*, 304*b* placed through two holes 402*a*, 402*b* engage the back side of the pegboard 400 while the locking plate 302 engages the front side of the pegboard 400 to prevent disengagement of the tines 304*a*, 304*b* from the pegboard 400; the second mount 350 tines 354*a*, 354*b* placed through two holes 402*c*, 402*d* engage the back side of the pegboard 400 while the locking plate 352 engages the front side of the pegboard 400 to prevent disengagement of the tines 354*a*, 354*b* from the pegboard 400. (The "front" side of the pegboard is the surface of the pegboard that faces the extended mount 390. The "back" side of the pegboard faces away from the extended mount 390. For sake of simplicity, the holes 402 other than two engaged holes 402*a*, 402*c* along section B-B have been omitted from the figures.)

Figure 4G:
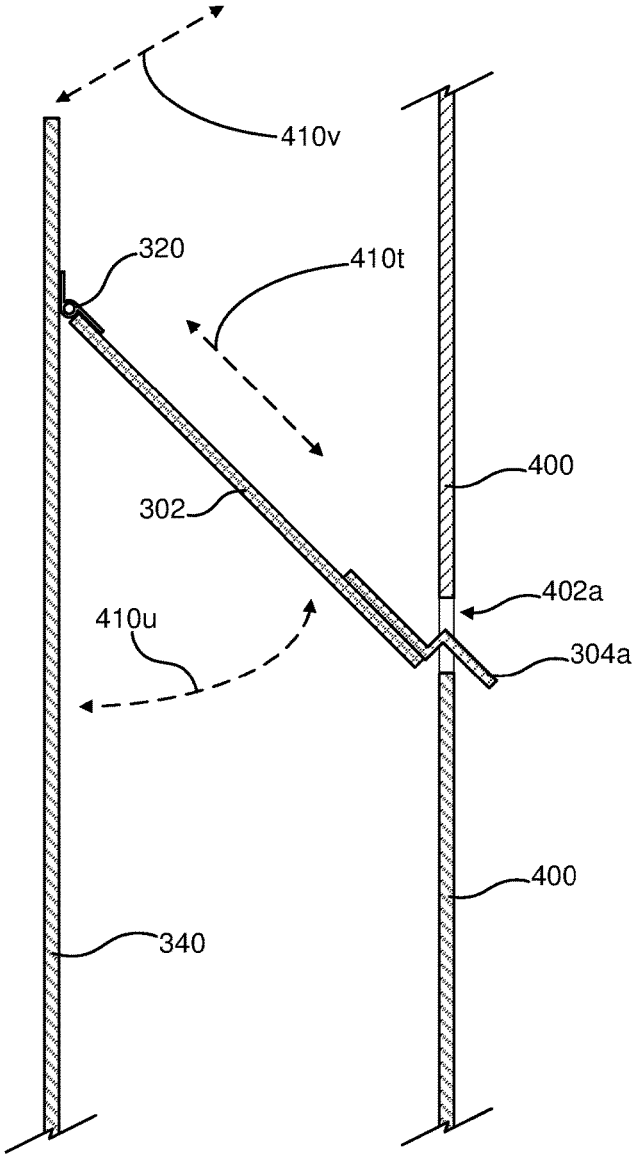
Figure 4H:
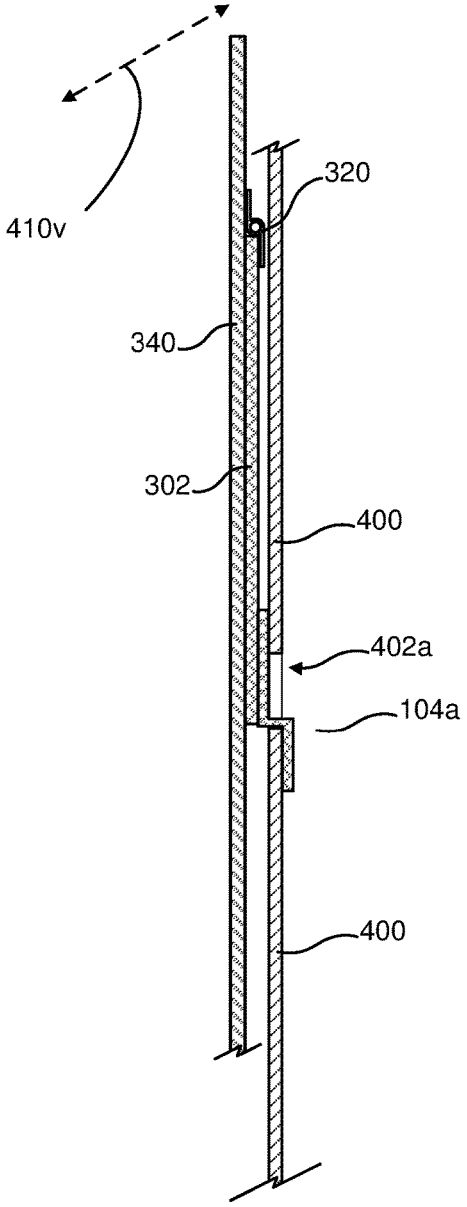

FIGS. 4G and 4H are side sectional views analogous to the view of FIG. 4E. In the configuration depicted in FIG. 4G, the mount 390 is in its unlocked configuration (shown in FIG. 3A) and may be moved 410*t* to insert or extract the first mount 300 tines 304*a*, 304*b* into or from the holes 402*a*, 402*b* and the spanning plate may be moved 410*v* to cause rotation of the mount 300 toward or away from the pegboard 400. (For sake of simplicity, only the first mount 300 is shown in FIG. 4G. The second mount 350 would be similarly situated.)

In the configuration depicted in FIG. 4H, the first mount 300 is still in its unlocked configuration and may be pivoted about the engagement point between the tines 304*a*, 304*b* and the engaged holes 402*a*, 402*b* by moving 410*v* the spanning plate 340. When installing the mount 390 to the pegboard 400, the spanning plate 340 would then be rotated about the hinge-pivot pins 326, 376 to place the engaged mount 390 into its locked configuration (as illustrated in FIG. 4E). When uninstalling the mount 390, the locking plate 302 may be pivoted away from the pegboard 400 (as illustrated in FIG. 4G) after the spanning plate 340 (and locking plates 302, 352) is moved from its locked position to its unlocked position. (For sake of simplicity, only the first mount 300 is shown in FIG. 4H. The second mount 350 would be similarly situated.)

Figure 5:
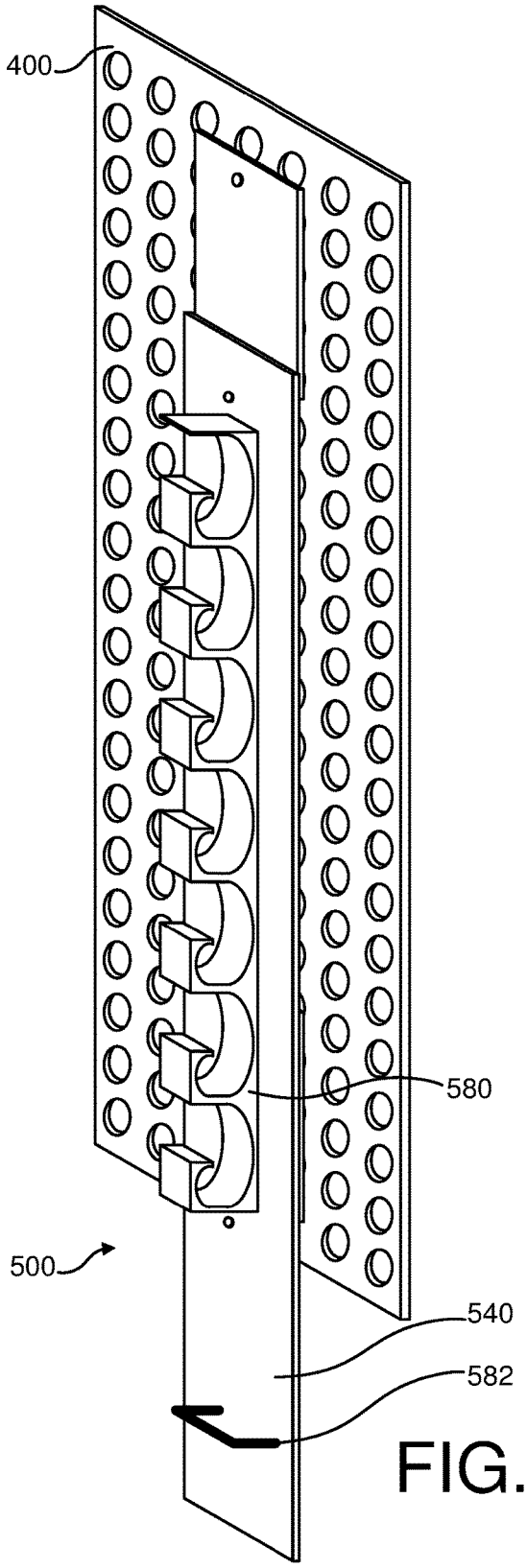
FIG. 5 is a perspective view illustrating an exemplary extended locking pegboard mount with exemplary item holders installed thereon.

FIG. 5 depicts an extended locking pegboard mount 500 installed on a pegboard 400. The extended mount 500 includes item holders 580, 582 attached or integral to a spanning plate 540.

Figure 6:
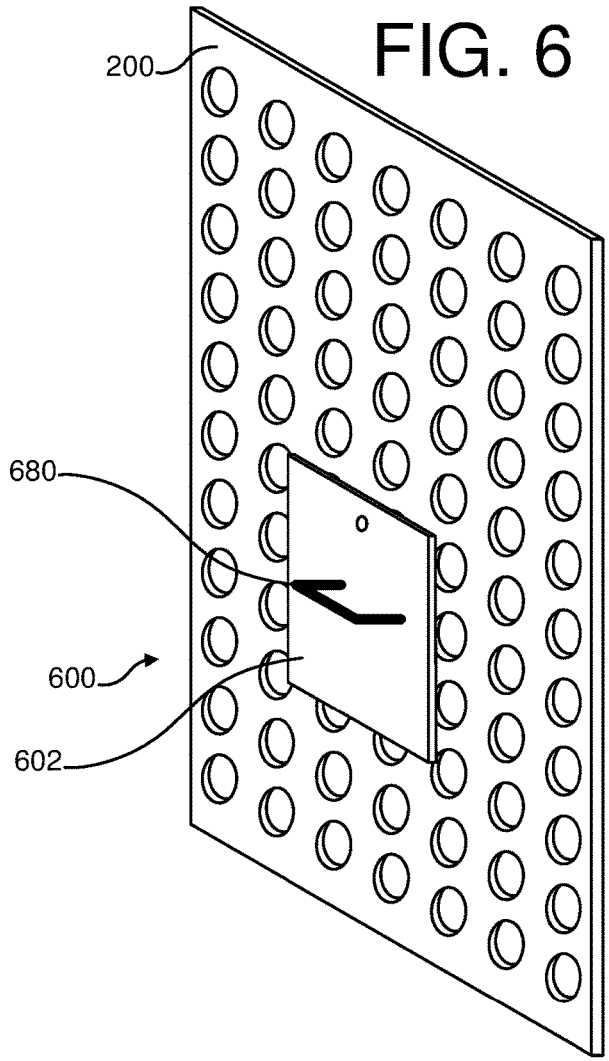
FIG. 6 is a perspective view illustrating an exemplary locking pegboard mount with an exemplary item holder installed thereon.

FIG. 6 depicts a locking pegboard mount 600 installed on a pegboard 200. The mount 600 includes an item holder 680 attached or integral to a locking plate 602.

Figure 7:
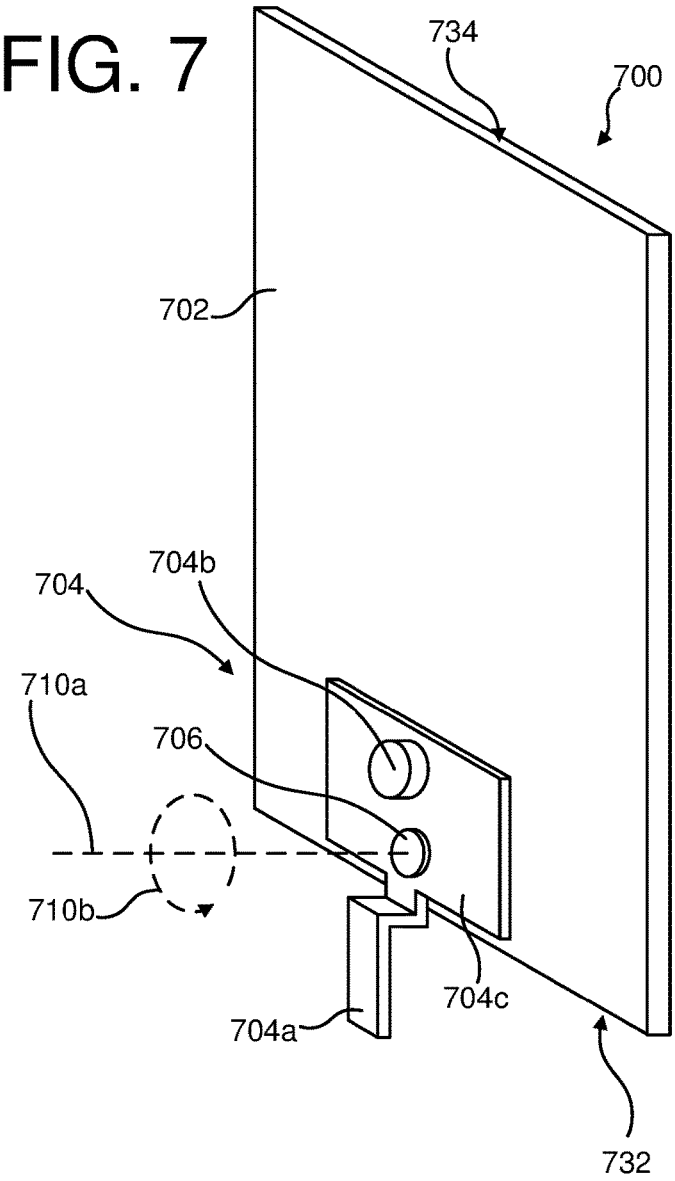
FIG. 7 is a perspective view illustrating an exemplary one-tine locking pegboard mount according to an aspect of the invention.
Figure 8:
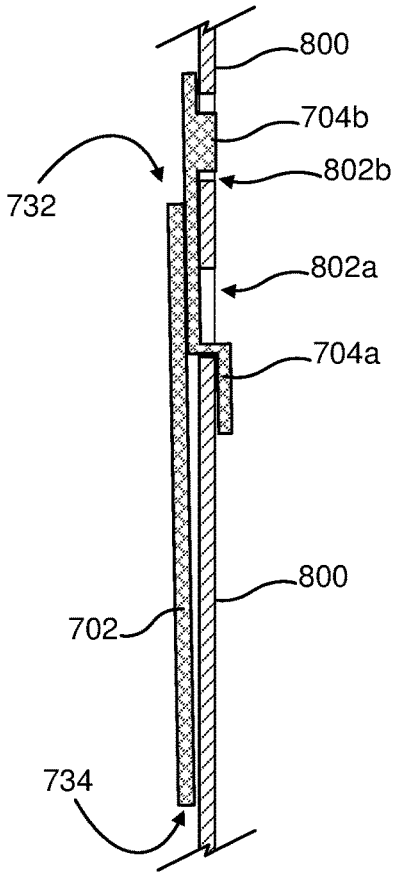
FIG. 8 is a side sectional view of an exemplary one-tine locking pegboard mount according to an aspect of the invention.

FIG. 7 is a perspective view illustrating an exemplary single-tine locking pegboard mount 700. The mount 700 includes a locking plate 702 and a pegboard engagement module 704. The mount 700 is similar to the mount 100 described with reference to FIGS. 1A and 1B. The difference is that the tine plate 704 comprises a single tine 704*a* and a nub 704*b* (a pin extending from the plate 704). The tine 704*a* is configured to engage a hole much as the previously described tines of the mount of FIGS. 1A and 1B. The nub 704*b* is configured to engage a separate hole. With both the nub 704*b* and tine 704*a* engaged with holes, the tine plate 704 will be held substantially rotation free relative to a mounting board while the locking plate 702 rotates 710*b* with respect to the tine plate 704 about a pivot pin 706 axis 710*a*. FIG. 8 is a side section view illustrating the mount 700 locked onto a pegboard 800, with the tine 704*a* engaging a first hole 802*a* and the nub 704*b* engaging a second hole 802*b*.

Figure 9:
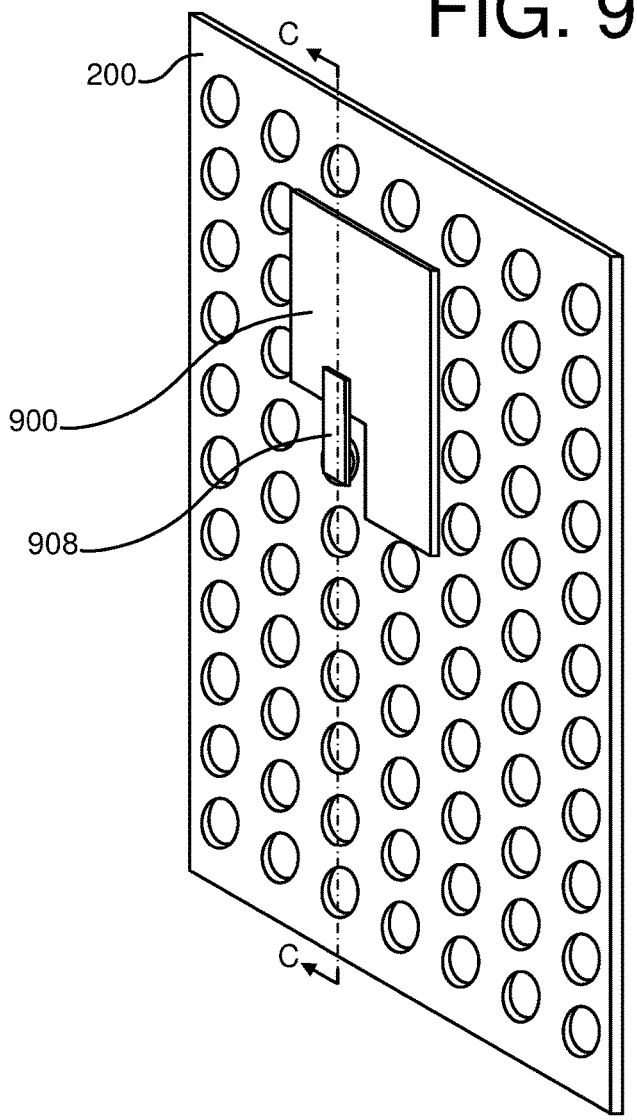
FIG. 9 is a perspective view illustrating an exemplary two-tine locking pegboard mount with a rotation lock according to an aspect of the invention in engagement with a pegboard.
Figure 10:
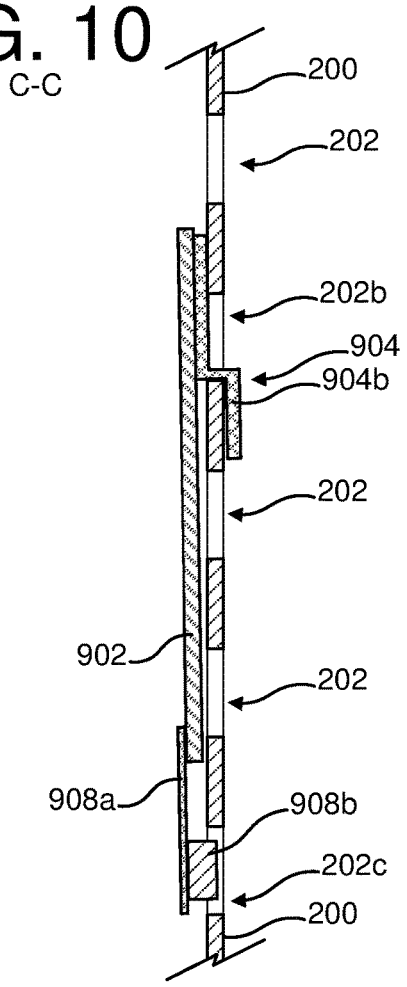
FIG. 10 is a side sectional view illustrating the engagement of an exemplary two-tine locking pegboard mount with a rotation lock with a pegboard.

FIGS. 9 and 10 are perspective and sectional views, respectively, illustrating an exemplary locking pegboard mount 900 with a rotation lock 908. The mount 900 includes a locking plate 902 and a tine plate 904 and may be instantiated, e.g., as the two-tine version of FIGS. 1A and 1B or the single-tine version of FIG. 7. In addition, mount 900 includes a detent 908 configured to engage a pegboard hole and thereby prevent rotation of the locking plate 902. In the exemplary embodiment, the detent 908 is implemented with a pin 908*b* attached (or integral) to a flat spring 908*a* in turn attached (or integral) to the locking plate 902. The spring 908*a* biases the pin 908*b* toward the pegboard 200 when the mount 900 is installed on the pegboard 200: the spring 908*a* forces the detent pin 908*b* in a hole 202*c*. In other words, the spring 908*a* biases the pin 908*b* in the direction out from the front face of the mount 900 (in a direction approximately normal to the mount's front surface). Attempts to rotate the locking plate 902 when the pin 908*b* is engaged with the hole 202*c* will be prevented by the pin 908*b* engaging the inside wall of the hole 202*c*. FIG. 10, a sectional view of section C-C of the FIG. 9, illustrates a mount 900 with a two-tine tine plate 904 mounted on a pegboard 200 in a locked configuration with the rotation lock 908 engaged with the pegboard. One of the tines 904*b* is shown engaged in hole 202*b*, the locking plate 902 is in the locked position, and the detent nub 908*b* is engaged in a second hole 202*c*. The detent 908 engagement prevents inadvertent unlocking of the mount 900 from the pegboard 200 by preventing rotation of the locking plate 902 about the pivot pin at the joint between the tine plate 904 and locking plate 902. To remove the mount 900 from the pegboard 200, the detent 908 must first be disengaged from the pegboard 200 by pulling the pin 908*b* out of the hole 202*c*.

Figure 12A:
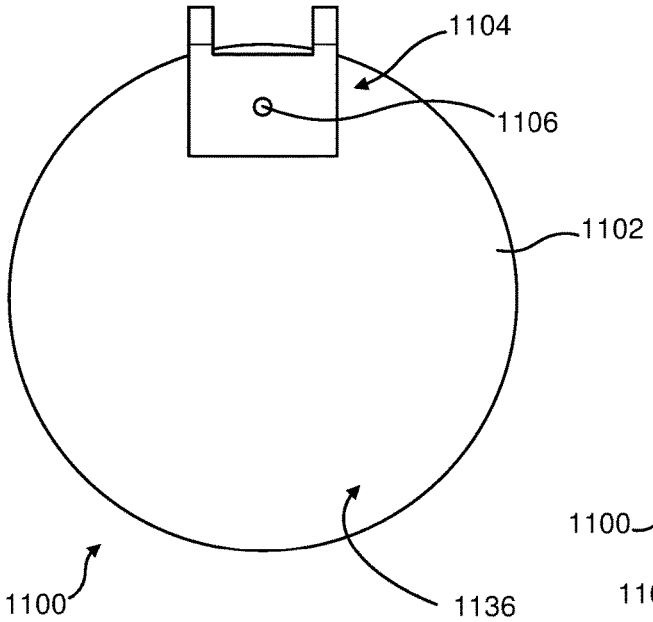
FIGS. 12A and 12B are front views illustrating an exemplary locking pegboard mount in the unlocked and locked configuration, respectively.
Figure 11:
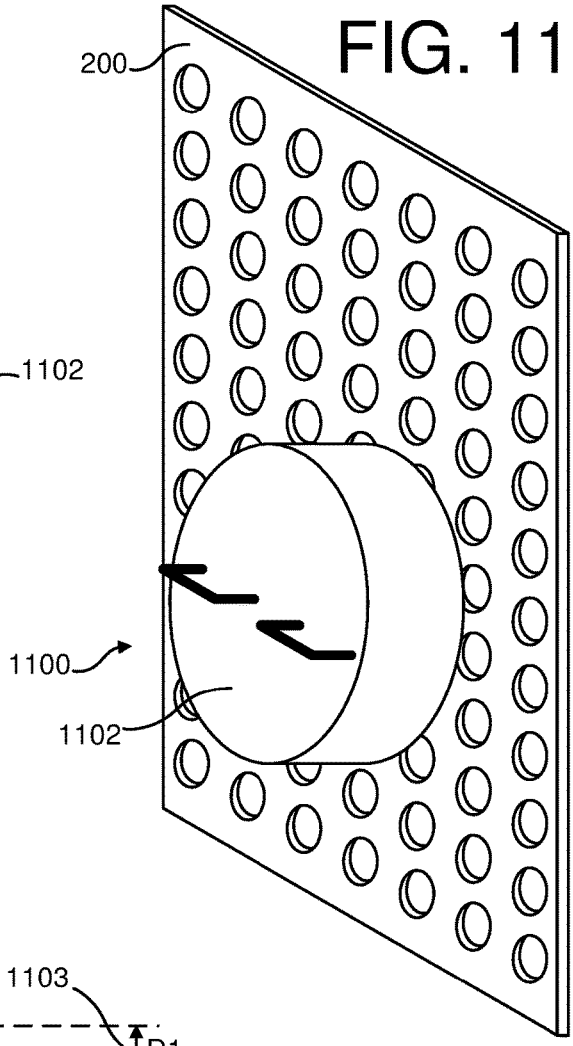
FIG. 11 is a perspective view illustrating an exemplary locking pegboard mount according to an aspect of the invention.
Figure 12B:
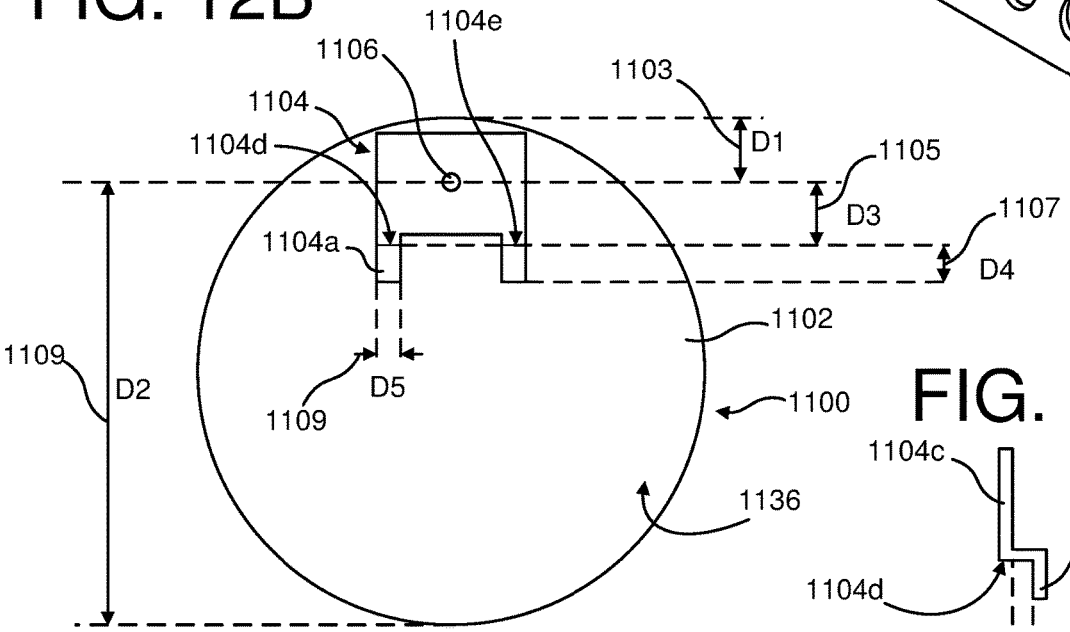
Figure 13:
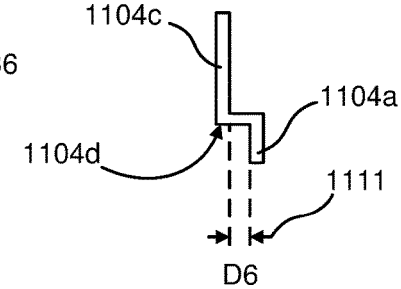
FIG. 13 is a side sectional view illustrating a tine plate of an exemplary locking pegboard mount.

FIGS. 11, 12A, 12B, and 13 are various views illustrating an exemplary pegboard mount 1100 and its components. FIG. 11 is a perspective view of the mount 1100 installed on a pegboard 200. FIGS. 12A and 12B are front views of the mount 1100 in the unlocked and locked configurations respectively. FIG. 13 is a side sectional view of a the tine plate 1104 of the pegboard mount 1100. The mount 1100 is similar to the previously described mounts in that it includes a locking plate 1102 and a tine plate 1104 which may be implemented with a single tine or multiple tines. In this mount 1100, the locking plate 1102 is circular and is dimensioned to significantly protrude from the pegboard 200 when installed. Here, the protruding dimension is to aid use of the mount 1100 by providing a greater surface for manual engagement by a user's fingers. Other shapes of locking plate may be used. The locking plate in FIG. 11 is shown as cylindrical, but it may be implemented, e.g., as a hemisphere, pyramid, cuboid, or truncated cone. The locking plate is not limited to a particular thickness or shape, so long as its front face 1136 allows rotation of an attached tine plate 1104 about a joint 1106 and has sufficient surface to one side of the pivot joint 1106 to prevent rotational movement of the mount 1100 relative to a pegboard 200 when installed on the pegboard and placed into the locked configuration.

The relative positioning and dimensions of the tine plate 1104 and locking member 1102 can be understood with reference to FIG. 12B. In this figure, various dimension lines are provided as dashed lines and dimensions as solid arrowed lines. The distance from the pivot joint 1106 (at the pivot axis) between the tine plate 1104 and the engagement edge of the front surface 1136 of the locking member 1102 is D1 1103. (The engagement edge of the surface 1136 corresponds to the side of the locking plate 1102 oriented to the pegboard when inserting the tine(s) into the pegboard hole(s). For example, in FIGS. 1A-1B side 132 corresponds to the engagement edge of the front surface 136 of the locking plate 102.) The perpendicular distance between the pivot joint 1106 and the tine hole-engagement surfaces 1104*e*, 1104*d* is D3 1105 (in a single-tine embodiment, the perpendicular distance is effectively the point-to-point distance). The length of the distal portion of the tine(s), from the hole-engagement surface 1104*d*, 1104*e* to the tine's endpoint, is D4 1107 (the "distal-portion length"). The distance between the pivot joint 1106 and the locking edge of the surface 1136 is D2 1109. (The locking edge of the surface 1136 corresponds to the side of the locking plate 1102 oriented away from the pivot joint 1106 in the direction of the tines in the locked configuration. For example, in FIGS. 1A-1B side 134 corresponds to the locking edge of the front surface 136 of the locking plate 102.) These dimensions have the following relationships: (1) D3 is substantially equal to or greater than D1, to allow engagement of the tine hole-engagement surface(s) 1104*d*, 1104*e* with the hole(s) without interference by engagement edge; (2) D4 is substantially equal to or greater than the diameter of the hole to engage, to prevent disengagement of the mount 1100 from the pegboard 200 without rotation of the mount 1100 relative to the pegboard 200; and (3) D2 is substantially equal to or greater than the sum of D3 and D4, to prevent any substantial rotation of the mount 1100 relative to the pegboard 200 when the mount 1100 is engaged with the pegboard 200 in the locked position (here, a rotation is "substantial" if it is sufficient to allow extraction of the tine(s) from the hole(s)).

As illustrated in FIGS. 12B and 13, the dimensions of the tine are related to dimensions of the mounting board (or like object) on which it is to be used. The width of the tine(s) 1104*a*, D5 1109 must be less than the inner dimension of the hole in which it is to be placed (e.g., D5 is less than the inner diameter of a circular hole). And the distance between the surface of the tine plate's mounting plate 1104*c* configured to face the board and the surface of the distal portion of the tine(s) 1104*a* configured to face the board is D6 1111 must be equal to or greater than the thickness of the board 200 (which is the depth or length of the through hole). Thus, the tine plate 1104 is configured for the mounting board on which it is to be used. Typically, a particular tine-plate configuration will be suitable for a range of perforated mounting boards.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A locking mount for engaging one or more holes in a mounting surface, the mount comprising:

(b) a locking member comprising a front surface having an engagement edge and a locking edge; and (c) a tine member comprising:

(i) a mounting plate; and (ii) a first tine extending from the mounting plate, the first tine: having a first proximal portion extending substantially perpendicular to the mounting plate and a first distal portion extending substantially parallel to the mounting plate, and providing a first hole-engagement surface oriented substantially perpendicular to the mounting plate;

(d) wherein the first distal portion has a first distal-portion length;

(e) wherein the mounting plate is pivotably connected to the front surface with a pivot joint at a point on the front surface a first distance from the engagement edge and a second distance from the locking edge and at a point on the mounting plate a third distance from the hole-engagement surface, wherein the pivot joint has a pivot axis and the point on the front surface and the point on the mounting plate are aligned with the pivot axis, and wherein the first proximal portion extends in a direction out from and substantially perpendicular to the front surface;

(f) wherein the third distance is substantially equal to or greater than the first distance; and (g) wherein the second distance is substantially equal to or greater than the sum of the third distance and the first distal-portion length.

2. The locking mount of claim 1:

(b) wherein the tine member includes a second tine extending from the mounting plate, the second tine: having a second proximal portion extending substantially perpendicular to the mounting plate and a second distal portion extending substantially parallel to the mounting plate, and providing a second hole-engagement surface oriented substantially perpendicular to the mounting plate; and (c) wherein the second distal portion of the second tine has a second distal-portion length.

3. The locking mount of claim 2 wherein the second distal-portion length is equal to the first distal-portion length.

4. The locking mount of claim 1 wherein the tine member includes a pin extending from the mounting plate in a direction substantially perpendicular to the mounting plate.

5. The locking mount of claim 1 further comprising a detent comprising a spring and a pin, wherein the spring and pin are configured such that the spring biases the pin in a bias direction substantially perpendicular to front surface.

6. The locking mount of claim 5 wherein the bias direction is out from the front surface.

7. An extended mount for engaging holes in a mounting surface, the extended mount comprising:

(b) a first locking mount comprising:

(i) a first locking member comprising a first front surface having a first engagement edge and a first locking edge;

(ii) a first tine member comprising: a first mounting plate and a first tine extending from the first mounting plate, the first tine: having a first proximal portion extending substantially perpendicular to the first mounting plate, having a first distal portion extending substantially parallel to the first mounting plate, and providing a first hole-engagement surface oriented substantially perpendicular to the first mounting plate;

(iii) wherein the first distal portion has a first distal-portion length;

(iv) wherein the first mounting plate is pivotably connected to the first front surface with a first pivot joint at a point on the first front surface a first distance from the first engagement edge and a second distance from the first locking edge and at a point on the first mounting plate a third distance from the first hole-engagement surface, wherein the first pivot joint has a pivot axis and the point on the first front surface and the point on the first mounting plate are aligned with the first pivot joint's pivot axis, and wherein the first proximal portion extends in a direction out from and substantially perpendicular to the first front surface;

(v) wherein the third distance is substantially equal to or greater than the first distance; and (vi) wherein the second distance is substantially equal to or greater than the sum of the third distance and the first distal-portion length;

(c) a second locking mount comprising:

(i) a second locking member comprising a second front surface having a second engagement edge and a second locking edge;

(ii) a second tine member comprising: a second mounting plate and a second tine extending from the second mounting plate, the second tine: having a second proximal portion extending substantially perpendicular to the second mounting plate, having a second distal portion extending substantially parallel to the second mounting plate, and providing a second hole-engagement surface oriented substantially perpendicular to the second mounting plate;

(iii) wherein the second distal portion has a second distal-portion length;

(iv) wherein the second mounting plate is pivotably connected to the second front surface with a second pivot joint at a point on the second front surface a fourth distance from the second engagement edge and a fifth distance from the second locking edge and at a point on the second mounting plate a sixth distance from the second hole-engagement surface, wherein the second pivot joint has a pivot axis and the point on the second front surface and the point on the second mounting plate are aligned with the second pivot joint's pivot axis, and wherein the second proximal portion extends in a direction out from and substantially perpendicular to the second front surface;

(v) wherein the sixth distance is substantially equal to or greater than the fourth distance; and (vi) wherein the fifth distance is substantially equal to or greater than the sum of the sixth distance and the second distal-portion length; and (d) a spanning plate;

(e) wherein the first locking mount is pivotably connected to the spanning plate and the second locking mount is pivotably connected to the spanning plate.

8. The extended mount of claim 7, further comprising:

(b) a first hinge comprising a first leaf and a second leaf;

(c) a second hinge comprising a third leaf and a fourth leaf;

(d) wherein the first leaf is pivotably connected to the spanning plate and the second leaf is connected to the first front surface;

(e) wherein the third leaf is pivotably connected to the spanning plate and the fourth leaf is connected to the second front surface.

9. The extended mount of claim 7 wherein:

(b) the first tine member includes a third tine extending from the first mounting plate, the third tine: having a third proximal portion extending substantially perpendicular to the first mounting plate and a third distal portion extending substantially parallel to the first mounting plate, and providing a third hole-engagement surface oriented substantially perpendicular to the first mounting plate; and (c) the second tine member includes a fourth tine extending from the second mounting plate, the fourth tine: having a fourth proximal portion extending substantially perpendicular to the second mounting plate and a fourth distal portion extending substantially parallel to the second mounting plate, and providing a fourth hole-engagement surface oriented substantially perpendicular to the second mounting plate.

10. The extended mount of claim 7 wherein:

(b) the first tine member includes a first pin extending from the first mounting plate in a direction substantially perpendicular to the first mounting plate; and (c) the second tine member includes a second pin extending from the second mounting plate in a direction substantially perpendicular to the second mounting plate.

* * * * *